US011077004B2

(12) United States Patent
Arnold

(10) Patent No.: US 11,077,004 B2
(45) Date of Patent: Aug. 3, 2021

(54) PATIENT MOBILITY GARMENT FOR NURSES

(71) Applicant: Jeanne Margaret Arnold, Bay City, MI (US)

(72) Inventor: Jeanne Margaret Arnold, Bay City, MI (US)

( * ) Notice: Subject to any disclaimer, the term of this patent is extended or adjusted under 35 U.S.C. 154(b) by 234 days.

(21) Appl. No.: 16/602,111

(22) Filed: Aug. 6, 2019

(65) Prior Publication Data

US 2020/0046588 A1 Feb. 13, 2020

Related U.S. Application Data

(60) Provisional application No. 62/764,579, filed on Aug. 8, 2018.

(51) Int. Cl.

| | |
|---|---|
| ***A61G 7/10*** | (2006.01) |
| ***A41D 1/00*** | (2018.01) |
| ***A61H 3/00*** | (2006.01) |

(52) U.S. Cl.

CPC ..... *A61G 7/1051* (2013.01); *A41D 1/00* (2013.01); *A61G 7/1013* (2013.01); *A61G 7/1023* (2013.01); *A61H 3/008* (2013.01); *A61G 2200/32* (2013.01); *A61G 2200/34* (2013.01); *A61G 2200/36* (2013.01); *A61H 2201/163* (2013.01)

(58) Field of Classification Search

CPC .. A61G 7/1051; A61G 7/1049; A61G 7/1013; A61G 7/1023; A41D 1/00; A61H 3/008

USPC ..... 5/81.1 T, 81.1 R

See application file for complete search history.

(56) References Cited

U.S. PATENT DOCUMENTS

| | | | | |
|---|---|---|---|---|
| 4,981,307 A * | 1/1991 | Walsh | ..... | A61G 5/10 2/311 |
| 5,115,802 A * | 5/1992 | Dyer | ..... | A61H 1/0222 602/33 |
| 5,498,219 A * | 3/1996 | Soufi | ..... | A47D 13/046 434/255 |

(Continued)

OTHER PUBLICATIONS

Inspire Outcomes LLC, "Instruction Manual for the Universal Mobility Coach System," 12 pages, 2013 A.D.

(Continued)

*Primary Examiner* — Robert G Santos

(74) *Attorney, Agent, or Firm* — Christopher John Rudy

(57) ABSTRACT

A patient mobility garment includes a flexible, laterally extending pelvic belt body having upper, lower, and opposite side borders, along with a plurality of spaced apart ribs placed in generally vertical directions substantially approaching or spanning the upper and lower borders; a plurality of loops vertically positioned with respect to one another about the ribs; a plurality of flexible, adjustable length girding straps horizontally oriented with respect to the pelvic belt body and configured to gird the pelvic belt body about a patient's pelvis area and bring the opposite side borders into conjunction or registry, each girding strap having a girding strap attaching member for fixation of the girding straps; a plurality of flexible, typically adjustable length shoulder straps; and a plurality of flexible, depending leg straps, each terminating in a fastener for engaging at least one of the vertically positioned loops. Busy nurses find it advantageous.

22 Claims, 12 Drawing Sheets

(56) References Cited

U.S. PATENT DOCUMENTS 6,073,280 A * 6/2000 Farnum ..... A61F 5/03 128/876
6,122,778 A * 9/2000 Cohen ..... A62B 35/0006 182/3
6,276,006 B1 * 8/2001 Hoit ..... A61G 7/1023 5/81.1 R
6,436,011 B1 * 8/2002 Cook ..... A63B 69/0064 119/770
6,752,776 B2 * 6/2004 West ..... A61H 3/008 602/32
6,908,131 B2 * 6/2005 Main ..... A61G 7/1023 294/150
6,942,630 B2 * 9/2005 Behan ..... A61F 5/0102 128/875
7,066,181 B2 * 6/2006 West ..... A61H 3/008 128/869
7,341,025 B1 * 3/2008 Streeter ..... A47D 13/046 119/770
8,147,252 B1 * 4/2012 Stanford ..... A47D 13/046 434/255
8,321,972 B1 * 12/2012 Vetter ..... A61G 7/1023 5/81.1 R
9,271,889 B2 * 3/2016 Binder ..... A61G 7/1013
9,420,832 B2 8/2016 Arnold
2002/0032103 A1 * 3/2002 Cook ..... A63B 21/4009 482/23
2003/0162636 A1 * 8/2003 West ..... A61H 3/008 482/69
2003/0195445 A1 * 10/2003 Behan ..... A61F 5/012 602/19
2004/0004367 A1 * 1/2004 Main ..... A61G 7/1023 294/150
2004/0230150 A1 * 11/2004 West ..... A61H 3/008 602/19
2005/0204470 A1 * 9/2005 Main ..... B66C 1/18 5/81.1 T
2013/0205466 A1 * 8/2013 Arnold ..... A61G 7/1051 2/83
2015/0136145 A1 * 5/2015 Binder ..... A61G 7/1013 128/845
2020/0046588 A1 * 2/2020 Arnold ..... A61G 7/1013

OTHER PUBLICATIONS

Arnold, U.S. Appl. No. 62/764,579 entitled, "Patient Mobility Garment for Nurses," filed Aug. 8, 2018 A.D.
Walking and Other Support Harnesses, images.search.yahoo.com, prior to Aug. 8, 2018 A.D.

* cited by examiner

100/100'
36"
12"
2"
4"
4"
2"
4"
2"
4"
2

PATIENT MOBILITY GARMENT FOR NURSES

This claims benefits under 35 USC 119(e) of provisional patent application No. 62/764,579 of Jeanne Margaret Arnold, which was filed on Aug. 8, 2018 A.D.

FIELD AND PURVIEW OF THE INVENTION

This concerns a patient mobility assistance device of the harness type. For example, the device includes a pelvic belt having adjustable leg and shoulder straps and a minimum number of attachment and fixation features highly amenable to practical application by nurses.

BACKGROUND TO THE INVENTION

Many harnesses, which are also known as slings and may be referred to as garments, are available to assist patient ambulation. These may be successful to various degrees, with various levels of ancillary equipment and caregiver interaction required.

Moreover, U.S. Pat. No. 9,420,832 B2 to Jeanne Margaret Arnold discloses a progressive mobility assistance garment for rehabilitation. In nature and gist, it provides an improved patient garment for assisting a caregiver in lifting, and performing therapy evaluation and treatment techniques on a patient, without having to change slings for each task. That garment comprises at least a pelvic belt having a width and length configured to fit around the waist of a human below the rib cage and above the hips and said length having an open front that contains at least one adjustable strap and buckle combination to secure that garment around a human torso, a top rim and a bottom rim; multiple fastening means attached to that garment along the top and bottom rims, and additional fastening means attached to the surface of that garment along its length and located between the top rim and the bottom rim of that garment. The invention of the '832 patent can include other pieces of garments that are attachable to the pelvic belt and detachable therefrom depending on the function desired by the caregiver. Embodiments of the same are commercially available as the Universal Mobility Coach System by Inspire Outcomes, L.L.C.

DISCOVERIES IN CONNECTION WITH AND GENESIS OF THE INVENTION

In spite of the multitude of available harnesses, including the progressive mobility assistance garment for rehabilitation of Arnold's '832 patent, nurses continue to choose not to use the garments available. In turn, lift companies continue to look for better products to meet the needs of this group of clinicians, but have fallen short in their efforts to meet these needs.

It is not the case that the progressive mobility assistance garment for rehabilitation of Arnold's '832 patent, especially embodied as the Universal Mobility Coach System, is not highly effective, particularly when employed by a rehabilitation specialist, its intended end user. It is highly effective, but it has a rather narrow application to this particular group of professionals.

Nurses as a rule, however, are not rehabilitation specialists. Nursing personnel in general have certain constraints attendant to their work, not the least of which is a lack of time in a busy workday schedule to be trained in using, hence to sufficiently understand, and as a consequence to operate, the detailed and specific equipment intended for rehabilitation specialists.

In turn, in response to feedback from nursing clinicians and sales teams in the safe patient handling and progressive mobility markets, the inventor made some significant changes to the above garment, which is clinically and functionally very different from the instant invention, to render it more generally useful to patient caregiver personnel such as nurses. These put the present device within the practical reach of nursing personnel, with excellent patient outcome.

The instant inventor—with her unique understanding of the clinical relevance and significance of the needs for this solution, for which, as far as is known by her, research and development teams from major lift companies have been unable to identify and draft solutions—has identified several salient considerations pertinent hereto:

For one, the healthcare industry continues to be challenged by shrinking reimbursement and need for better patient outcomes. This trend has continued to create increasing challenges for healthcare providers, as noted in the background for Arnold's '832 patent.

For another, the push is on for more nurses to be more involved in helping to walk their patients and get them out of bed and walking (multidisciplinary mobility). There are, however, many problems associated with this, to include the following six general problems (I-VI):

(I) Nurses are incredibly busy, and it takes time to get patients up and out of bed. Major barriers have been identified with staffing and equipment shortages or shortfalls in efficiency and effectiveness to help them ambulate patients safely and in a timely fashion. If the nurse uses fifteen minutes with one patient applying a sling or harness system, that is fifteen minutes less to bathe the next patient, to help another to turn over, to get a glass of water for another, to bring a bed pan, to provide assistance to get to a commode for another, to document how the patient is doing, and so forth. There are many, many tasks that nurses juggle constantly in the course of taking care of their patients.

(II) There is inter-professional conflict about whose role it is to ambulate patients. Despite activity and walking patients being part of the scope of nursing practice, in recent years therapists have increasingly adopted this role. Most equipment companies trying to find effective solutions do not fully understand these conflicting roles, nor do they understand how to overcome the resistance with which they are met when trying to sell their "ambulation solutions" to nurses. When such companies try to sell to organizations for nursing staff their ambulation solutions, their slings and harnesses fall short of what nurses need, and so they are left without an effective solution for this important clinical problem. The instant inventor understands the challenges of both nursing and therapy, and the time crunch and competing priorities that are barriers to using solutions heretofore known.

(III) One key factor that is crucial to understanding the need for the design features set forth below is an understanding of why current solutions are not used. The reasons why nurses choose to either provide manual assistance, which is unsafe for them and the patient, or to refrain from walking their patients who are at risk for falling or who require assistance to walk, which is not an acceptable solution for the patients, may be generally be categorized as relating to problems with current harnesses and slings on the market, which, in general, are threefold (1-3):

(1) There are too many options to choose from. This is also a notable limitation of the progressive mobility assistance garment for rehabilitation of Arnold's '832 patent as it would apply to nursing personnel. Nurses are always in a hurry. Patients need to go to the bathroom with a degree of urgency, and having to take time to choose the tight size of sling, the right combination of components, and to put them together is not feasible for nurses to do. They need one solution and one size, for the vast majority of patients. Even having to choose between small, medium, large and extra-large can be a barrier. If a nurse chooses the wrong size, for example, then there are potential consequences, among which are mentioned the following (i-iii):

(i) The safety of the patient can be compromised. If too small, the sling will not support the patient or may pinch and be uncomfortable; if too big, the patient can slide through, and the sling can ride up if the patient falls. The whole point of the harness is to protect the safety of the patient and the caregiver if the patient falls or loses his balance.

(ii) When learning and adopting new tasks and behaviors, i.e., changing culture, human experience and studies show that if a person put forth the effort to try the new task and it does not go well, the likelihood of repeating that experience decreases. The instant inventor has experience in changing culture and understands that, when values of time/productivity versus safety mutually oppose, time is often chosen, and short cuts are taken to attempt to get the job done, even when their own safety is in the balance. Ill-fitting or incorrect sizing for patient harnesses can increase frustration in nurses and resistance to using new "safety" equipment because the nurses' efforts to comply with the changes can be met with an unsuccessful outcome. The "safe" solution must not add a burden of time that could compromise the ability to achieve the tasks that are demanded in a given time period, and must fit the patient well and have a high likelihood of a smooth and successful outcome when employed. This is an important limitation of current designs that are available today.

(iii) The problems above (i, ii) may result in one of two things occurring. For one, the nurse may take a risk of ambulating the patient without the safe solution/harness. For another, the nurse may not ambulate the patient, and the patient will get weaker from not walking.

In address of this, the present patient mobility garment for nurses retains elements of the progressive mobility assistance garment for rehabilitation of Arnold's '832 patent in terms of one size fits all (or most) through the unique features disclosed herein of each piece being adjustable in multiple places such as pelvic belt, leg straps/supports, connector straps, and a collapsing additional section in the pelvic belt. The present garment for nurses, however, is significantly altered to simplify and reduce complexity for this new application for a new end user, a nurse, whose needs and role related to patient mobility are significantly different from those of a rehabilitation professional, who was the primary target end user of the progressive mobility assistance garment for rehabilitation of Arnold's '832 patent.

(2) The harness or sling needs to fit properly. It needs to be comfortable and not slip up on the patient's body. After the challenge of choosing the right size, this is another big barrier to using the designs that are currently on the market. If the nurse is going to take the time to put the harness on the patient, and the patient is uncomfortable or cannot get it to fit properly, a patient's complaints can deter the nurse from choosing a safe option to walk him. Apropos here are a pair of related considerations (i, ii):

(i) Patients are very heterogeneous in body mass distribution. For example, one patient may have a large waist, and smaller legs; and another may have large thighs, but small hips and a small waist. Some patients have longer torsos than others, and so forth. Even with multiple sizes on other designs, the ability to adjust each component sufficiently so as to conform in a smooth and easy way to the heterogeneous nature of patient body types is not known to the inventor to be currently available with those other designs, except for the progressive mobility assistance garment of Arnold's '832 patent. In the garment of that patent, however, alluded to previously, this adjustability was achieved through employment of multiple, separate pieces, which, again, from the point of view of the nurse end user, was overly complex.

(ii) Again, the result can be that either the nurse chooses the unsafe option, or that the patient is not walked at all. Both of these are unacceptable options.

In address of this—in addition to the present patient mobility garment for nurses that retains elements of the progressive mobility assistance garment for rehabilitation of Arnold's '832 patent in terms of one size fits all (or most), through the unique features disclosed herein as noted above, and the present garment for nurses being significantly altered to simplify or reduce complexity for this new application for a new end user, a nurse, as also noted above—the instant invention provides for adjustability in all dimensions of the present patient mobility garment for nurses so as to be able to accommodate patients of nearly if not fully all shapes and sizes, of course, up to the safe working load of the garment. This functional feature, retained from the progressive mobility assistance garment for rehabilitation of Arnold's '832 patent, is different therefrom in the way in which it is accomplished in the present simplified garment for nursing. In other words, the instant invention has new and additional considerations in address of complexity through a multiplicity of separate pieces, which embody a multiplicity of adjustable features in one garment, not through provision of separate pieces. Thus, in simplifying the garment, yet retaining the one size fits all (or most) feature, the inventor drew on anthropometric data of body composition, as well as information on movement anatomy, physiology and kinesiology for patients of different sizes and functional levels. This was coupled with clinical experience of the difficulties encountered with heretofore known designs in not adequately supporting patients of a large range of body shapes, sizes and weights, in order to strategically place every belt and buckle for the most efficient adjustability, to include ease of adjustability, with the understanding that if it is not easy to adjust, nurses may well not use it owing to the time factor that they encounter. Taken into consideration then for all adjustable pieces, are materials, the force required to adjust buckles, and their ability to "hold" a strap in position, all the while considering ease of adjustability when desired by the nurse, hand placement and direction, for increased joint/muscle efficiency, and adjustability and interaction with the patient, and the lift employed so as to satisfy the needs of nurses, who, again, are busy, yet who indeed want to do the best for their patients, without compromising other important aspects of their care.

(3) The harness needs to be easy to apply and/or adjust with the patient in lying, sitting, or standing positions. Vest-style ambulation slings, however, cannot be applied in the lying position. Additionally, slings that have fixed length connector straps to connect to the lifts are not feasible to use from the lying position as they are not long enough to have the lift positioned above the patient's head to assist with coming to a sitting position if needed.

In address of this—in addition to the present patient mobility garment for nurses that retains elements of the progressive mobility assistance garment for rehabilitation of Arnold's '832 patent as mentioned above—the strategic placement of straps, materials selected, the alignment of loops, and the number and location of adjustable mechanisms have all been considered, keeping in mind that the solution must be able to be applied easily in the lying position for patients who are larger, whose bed may be damp, or who may have pain or a compromised ability to move. The unique manner in which the present leg supports adjust and attach to the pelvic belt makes it very easy for a nurse to apply. The way the instant invention adjusts through multiple mechanisms, which is different from other designs on the market, is a significant part of what makes it such a unique and effective solution. Furthermore, the instant invention is applied around the pelvic region, usually below the waist as in larger or more fully grown patients, and can be applied while the patient is in a lying or a sitting position. The inventor recognized that muscle activation and relative lengths of torso, legs, and total body heights as the patient changes his position from lying, to sitting, and then ultimately to standing, play a significant part in provision of the instant invention. The ability to adjust all parts of the sling easily in any position, makes the instant invention uniquely capable of providing proper patient support as the patient moves through different positions.

Although the progressive mobility assistance garment for rehabilitation of Arnold's '832 patent fits well; is easy to apply, when a practitioner knows how; meets the needs of the therapist as intended; and has a vast capability for adding or removing support, and adjusting levels of difficulty for patients at any point on the garment, the needs of nurses are different. Therapists, on the other hand, have asked for more loops and more options. And, while therapists perform multiple movements in one treatment session, a nurse will assist a patient with one activity. This may be passively getting into a chair (heretofore, using a dependent chair style sling); turning a patient in bed (heretofore, using a turning sling); helping transfer a patient to a chair actively (heretofore, perhaps using a sit-to-stand sling with a sit-to-stand lift); or walking a patient to the bathroom (where, heretofore, if not using a lift or lift/sling combination to assist with patient ambulation, and the patient is not safe, the patient will not be walked to the bathroom). Nurses, however, need a simple solution that is readily understood, quick and easy to apply, and works well for the intended task. Feedback from nurses on the progressive mobility assistance garment for rehabilitation of Arnold's '832 patent indicates that there are too many options for them, too many loops, and too many pieces, and it is too complicated. Thus, it will not be used by nurses.

It is important to realize that nurses and other clinicians, who are not skilled in design and human anthropometry, do not know how to simplify it. They just know it is too complex. It would not be obvious to them which loops to get rid of, where to put straps if there were fewer of them, how to achieve adjustability without losing support, and how to attach pieces strategically to support multiple patient sizes and shapes without compromising support and ease of use.

(IV) The new configuration needs to be able to retain adjustable features but with a more simple application. Resultant changes of the instant invention are based in significant part on knowledge of work flow and geographic location of work tasks between therapists and nurses. Therapists have a central location where they store their equipment, either in a therapy department when in acute care, where therapists take the equipment they need to the patients' rooms where the equipment is needed; or in an environment of care outside the acute care hospital, where therapy treatments take place in a therapy gym and patients come to the gym rather than therapists going to patient rooms. This means that the progressive mobility assistance garment for rehabilitation of Arnold's '832 patent can be in many pieces, and can be stored (often hung on a wall) in the therapy gym, for use in one environment by the therapists. Nurses, however, have a much different environment. They are always working from patient room to patient room, on multiple patients. There are many more people going in and out of storage areas, and typically no one is accountable for inventory of all of the equipment at the end of each day. While the progressive mobility assistance garment for rehabilitation of Arnold's '832 patent functions well in a therapy gym where there is usually someone to help clean up the gym area and put all of the equipment back where it goes, nursing work flow and flow of equipment is much different. This is not just for slings, but for all equipment. The real world of nursing is very fast-paced and designs need to be accessible, and easy to use and account for. In addition, storage in nursing units often is limited; having one solution that fits most patients, rather than having multiple sizes of slings, helps reduce storage, and allays labeling needs as well. Also, cleanliness is of notable concern, to include when a mobility garment is shared among patients.

In address of this, the instant invention retains valuable components of the progressive mobility assistance garment for rehabilitation of Arnold's '832 patent, but is configured to take into account the understanding that nurses need one garment, which can be kept in a certain spot, preferably hanging up so that it can be grabbed and used quickly and easily. In light of the foregoing, provided hereby is just one garment, rather than multiple, separate pieces. Others have not been successful in finding the source of, much less a solution for, this problem or need, as many facilities have been persuaded that they need a various slings by manufacturers, which, however, the clinicians seldom use. Moreover, as mentioned elsewhere, the present provision can be wiped with approved disinfectant by busy nurses between uses, helping to keep it clean.

One experience illustrative of the latter, which the instant inventor had with a facility that wanted to see a commercial embodiment of the progressive mobility assistance garment for rehabilitation of Arnold's '832 patent, was that they already had ambulation harnesses from another company. When asked to see what they had, they first had to find the key for the cabinet. That meant that no one would be using their ambulation harnesses (slings) since the cabinet was locked and the key needed to be retrieved. When asked why the cabinet was locked, they shared that they were worried that the slings would get lost, and parts of slings would get lost. When the key was retrieved and the cabinet was finally opened, there were no less than twenty slings, all different sizes, all different shapes. When the staff was asked which one they used for ambulation and they said: "We don't! There are too many to choose from; so we don't use any." This experience, among others, spurred the conception and reduction to practice of the present invention since it was realized, among other things, that too many parts could be lost. Having too many parts and too many options was a barrier to use by nurses, and so they did not use any. The inventor, however, found one solution that can fit most patients; has the strength and the operable features to fit well, and properly support the patient through the necessary movements; can be used from patient to patient without having to launder it between uses; and presents the fewest decisions possible, particularly by busy nurses, so as to achieve the greatest number of applications, and benefit the greatest number of patients. This invention accomplishes these things in ways not accomplished heretofore by any of the harnesses on the market.

(V) Most sling designs are either single patient use (throw-away after using with one patient) or they are to be laundered, which involves sending them to a laundering facility, often off premises. The former case represents a very expensive option when many slings are utilized; it is implemented to help prevent spread of infection from one patient to another, and to ensure that the harnesses are accessible when they are needed. In the latter case, if the harnesses need to be laundered between use by different patients, then the facility must have a lot of them to cover laundry turn-around times. For example, in a typical scenario, if there is one different patient each day who needs a walking sling, then the facility must obtain four to five harnesses to cover the laundry turn-around time. Thus, a harness used on Monday will go out to the laundry on Tuesday and may not make it back to the unit until Friday, which means that a new or cleaned harness must be available for use on Tuesday, another for Wednesday, and still another for Thursday—assuming that the harnesses come back from the laundry at all, as many slings are lost to external laundry facilities owing to complicated processing.

In address of this, the instant invention can be made to be wiped down between uses. This wipeable nature further makes the invention valuable to busy nurses because they can spray or wipe the harness with an approved disinfectant, and then use the harness on the next patient. It also makes the invention valuable to the institution since a significant reduction in inventory can be achieved, thus saving costs.

(VI) There are various styles of patient lifts used in conjunction with harnesses or slings, which a nurse could use to assist with ambulation of a patient. As is well known in the art, typically these are of two types:

The first is a ceiling-mounted lift, usually placed over the patient's bed. These lifts can accommodate many kinds of slings, and are most often used for repositioning tasks in and around the bed, as evidenced by their location. Some versions of these have tracks that traverse to hallways or into bathrooms, which could be used for ambulation. Most of these, however, have limited application for ambulation away from the patient's bed.

The second is a floor-based lift having a base on the floor and an upwardly projecting member from which the sling hangs or depends. Typically, these are mobile, for example, by provision of wheels or ball rollers, and also can be used for ambulating a patient.

As is also well known in the art, both the ceiling-mounted and floor-based lifts have hanger bars to which the harness or sling attaches. These are called, "loop-style hanger bars," as the connecting portion for the harness or sling is a loop. Some standing and raising aids (SARAs) also have footplates that can be removed. Either loop-style or lock-and-loop-style connections with the body harness or sling are employed.

All other ambulation harness or sling devices currently available on the market can be used with only one type of lift. Often on a busy nursing unit, that particular one type of lift required for a particular harness or sling is being used with another patient. In turn, limited access to an appropriate lift can be a further barrier to busy nurses.

In address of this, the instant invention is configured to be able to be used with loop-style and lock-and-loop-style lifts. This provides nurses with readily accommodated options, as they still are able to ambulate their patients with a different style of lift if one style of lift is already in use or otherwise is not available.

Some Differences from the '832 Patent

Some differences between the instant invention and the progressive mobility assistance garment for rehabilitation of Arnold's '832 patent, are set forth as follows:

There are fewer loops. Nurses do not know how many they need, or where they need them. The instant invention incorporates the fewest number of loops necessary to retain ready adjustability and multiple sizing of the progressive mobility assistance garment for rehabilitation of Arnold's '832 patent, and places them strategically for optimal strength and ease of applying the supports, as well as placing them strategically to adjust to the widest range of body types and still provide the necessary support but without extra loops that the therapist version has. To provide this requires in-depth knowledge of patient body mass distribution and body mechanics to optimize muscle function, and successful ability for the patient to be able to perform the movement task that they are not able to provide on their own. As noted above, therapists ask for more loops, because of the nature of how they use the product, and how they mobilize their patients. Nurses have very different needs, and a different focus to their mobility activities. Nurses do not focus on individual patient muscle functions, and how patients go through each movement. Nurses want to get each patient to where he needs to be—safely and quickly. They are less concerned with small degrees of support or patient progress in activities than therapists are focused on; thus, not as many loops are needed. Heretofore, knowledge of differences in work tasks and nuances of how nurses move patients versus how therapists move patients, although found to be of paramount importance, has not been adequately considered, if at all.

The core function that has been chosen in the instant invention addresses an important gap in designs that are currently available. There is increasing pressure for nurses to walk more patients as the problems with patients not getting out of bed while in hospital or in nursing homes is more and more being fully realized. The push now is to walk them early in their length of stay, and to walk them several times per day. It is also known that persons who live in nursing homes need to walk more, and this task falls primarily on nursing staff. As noted, however, there is a conflict in values and risks, between the risk of patients falling, and the need to walk them. There is a tendency towards keeping patients in bed so that they do not fall, but every day that is spent in bed makes the patient weaker, and increases their fall risk. This juxtaposition is driving an increased need for nurses to get their patients up, but the risk of patients falling is still a barrier. The instant invention takes this into account, and simplifies the progressive mobility assistance garment for rehabilitation of Arnold's '832 patent, understanding that for the new functional application, complexity and versatility is being replaced by simplicity, while retaining key features that continue to differentiate the present product from others that are currently available. The instant invention connects the leg supports to the pelvic belt in strategic alignment so that the nurse does not have to decide where to put the leg supports. This removes one level of complexity, and removes the likelihood of the leg strap getting lost.

The alignment of the leg supports relative to the strength of the supporting (connector) straps has been strategically placed and pre-decided, rather than allowing the nurse to determine where to attach the leg supports. The strategic placement is based in significant part on the inventor's knowledge of anthropometric data, and kinematics of movement to maximize support of the pelvis, the powerhouse for all movement, for the greatest number of patients, who may vary appreciably in size and weight, and who require support and assistance to move and walk.

The connector straps that were separate pieces on the progressive mobility assistance garment for rehabilitation of Arnold's '832 patent are strategically pre-decided also in the instant simplified nursing version whereof. Again, there are many styles of harnesses on the market that have the shoulder straps sewn to the pelvic portion, however getting a good fit with comfortable support that is easy to apply and can be worn by a multitude of patient sizes and body types is heretofore lacking. The unique way that the pelvic belt adjusts and expands as an accordion bellows for maximum versatility of girth accommodation without compromising support as employed in the progressive mobility assistance garment for rehabilitation of Arnold's '832 patent is retained in the instant invention, and the strategic placement of the connector straps so as to connect the belt to the lift that will provide mechanical support to prevent the patient falling or losing their balance allows for the multi-sizing feature to be effective clinically.

The padded fall prevention straps that go through the patient legs of the progressive mobility assistance garment for rehabilitation of Arnold's '832 patent are significantly modified in the instant invention. The multi-functionality of the progressive mobility assistance garment for rehabilitation of Arnold's '832 patent generally had those padded supports being rectangular in shape to accommodate their multi-functional role as upper body or torso supports, lower body supports, or additional support in any plane of movement, connected to the pelvic belt. In the instant invention, however, the shape and dimensions of this support are changed from the progressive mobility assistance garment for rehabilitation of Arnold's '832 patent and from the designs known to be available on the market, which also have a basic rectangular leg support strap, which when tight enough to feel comfortable on the patient and prevent them from sliding down in the sling prior to the sling, thus catching them, is uncomfortable because it does not conform to the natural anatomical support area, the ischial tuberosities, i.e., the "sit bones," felt when sitting down. On the other hand, a significant change in the buttock padding/support is provided hereby, which retains an ability to slide along the rigid strap to enable proper placement in a variety of patient sizes and shapes but conforms to the curvature of the buttock region so as to provide proper support under the ischial tuberosities, yet does not impede the ability to move the legs for walking. In other words, padding is provided that is enough to be comfortable, but yet not more than needed so that walking is as unimpeded as possible.

The instant invention may be considered to be, in general, a one-piece garment—as can be gleaned from the present specifications, and as components of adjustable features—such as connector straps that attach to the pelvic belt to a lift, the vertical loops, and the ribs that provide adjustability around the pelvic area, and the adjustable leg straps that can be and preferably are continuous with the connector straps yet individually adjustable as to length and position of a support pad when present—are integrated into one garment, yet are still fully adjustable in all salient respects. Strategic placement of the adjustable components has accomplished a maximum of versatility and fit for a maximum range of patient body shapes, sizes, and levels of dependency, while still providing strength and support in one general piece, which can be wiped down between uses from different patients.

FURTHER DISCLOSURE OF THE INVENTION

Provided hereby is a patient mobility garment for nurses, which comprises, comprises essentially, consists essentially of, or consists of a flexible, laterally extending pelvic belt body having upper, lower, and opposite side borders, and in conjunction therewith, the following:

- a plurality of spaced apart structural reinforcement members (ribs) placed in generally vertical directions that substantially approach or span the upper and lower borders;
- a plurality of loops vertically positioned with respect to one another about the ribs;
- a plurality of flexible, adjustable length girding straps horizontally oriented with respect to the pelvic belt body and configured to gird the pelvic belt body about the pelvis area of the patient and bring the opposite side borders into conjunction or registry, each girding strap having a girding strap attaching member for fixation thereof;
- a plurality of flexible, typically adjustable length suspension straps (shoulder straps); and
- a plurality of flexible, depending leg straps terminating in a fastening contrivance for engaging at least one of the vertically positioned loops.

By the invention, the art is advanced in kind, and numerous problems are ameliorated if not completely solved as alluded to as aforesaid. The invention has numerous advantages as alluded to as aforesaid. Notably among these mentioned here are improved ease and time needed by nurses to apply to a patient the present patient mobility garment; one garment having many options in size and body peculiarities; and ability to be used on lock-and-loop-style sit-to-stand devices or loop-style hanger bars. As well, because one harness or sling generally as a one piece unit fits multiple patients, and the harness or sling can be wiped down or sprayed with approved disinfectant between uses, storage, use and cleanliness are enhanced, especially on nursing units, and nurses have one option to employ that will work for most if not all of their patients. The invention is easy to use, particularly by nurses, and easy to clean between uses. This increases use, and acceptance from nursing staff Patient satisfaction is heightened as well. The invention is economical to manufacture. Numerous further advantages attend the invention.

DRAWINGS IN BRIEF

The drawings form part of the specification hereof With respect to the drawings, the following is briefly noted:

FURTHER ILLUSTRATIVE DETAIL

Figure 1:
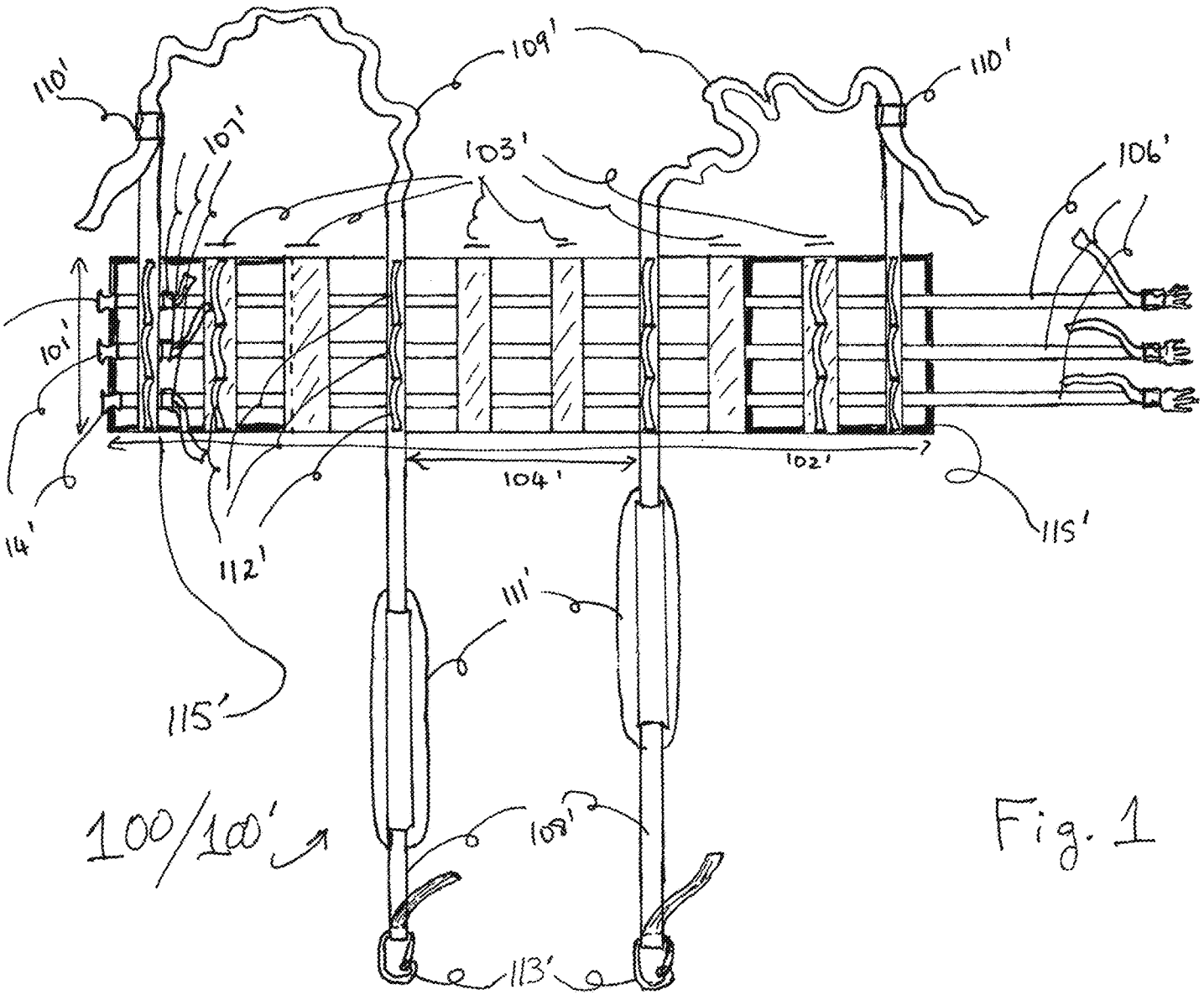
FIG. 1 is an elevational view of a patient mobility garment for nurses, expanded, in general, showing the side facing external to, i.e., away from, the patient when it is worn.
Figure 2:
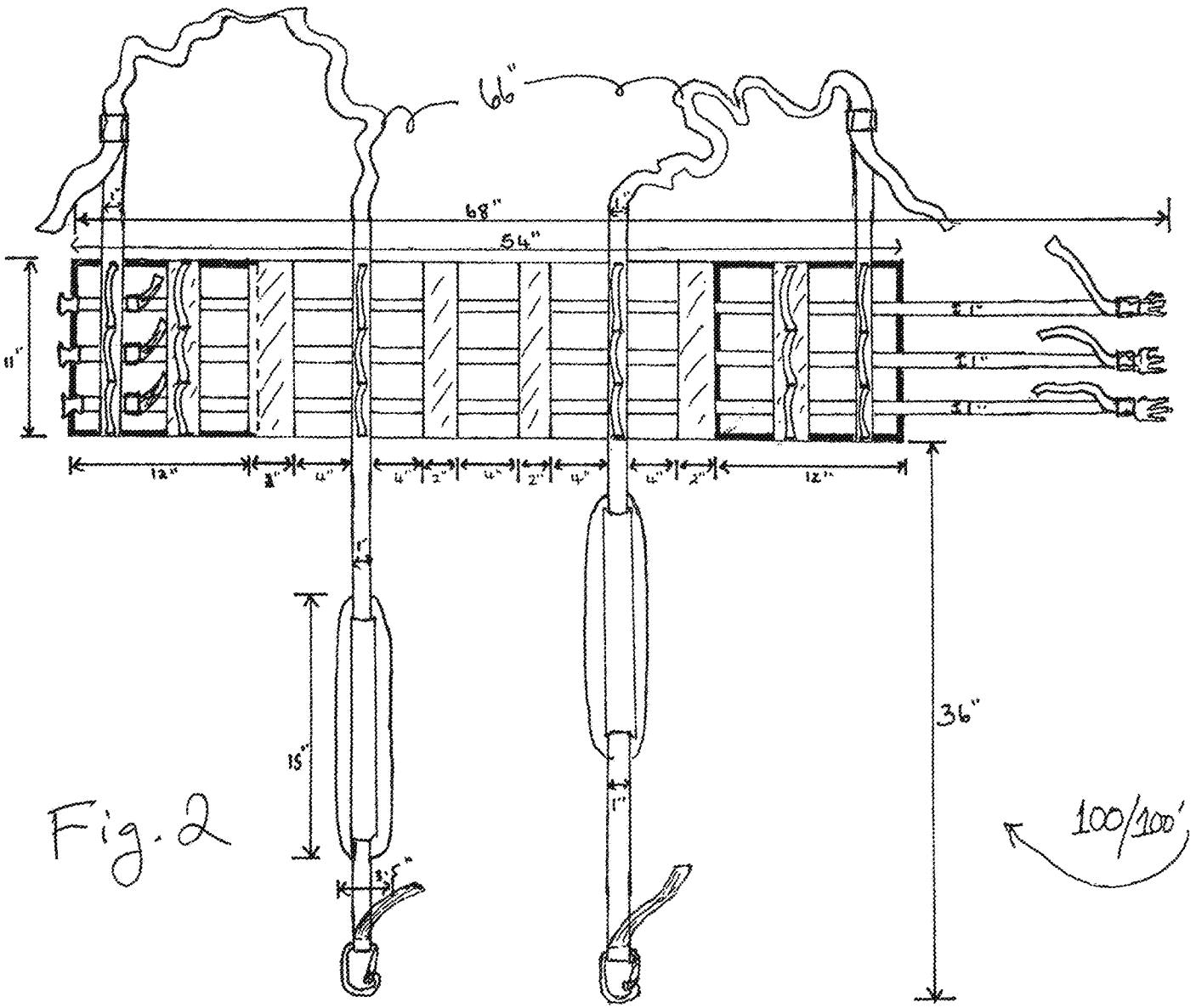
FIG. 2 is an elevational view of the garment of FIG. 1, illustrating some exemplary dimensions in inches.
Figure 3:
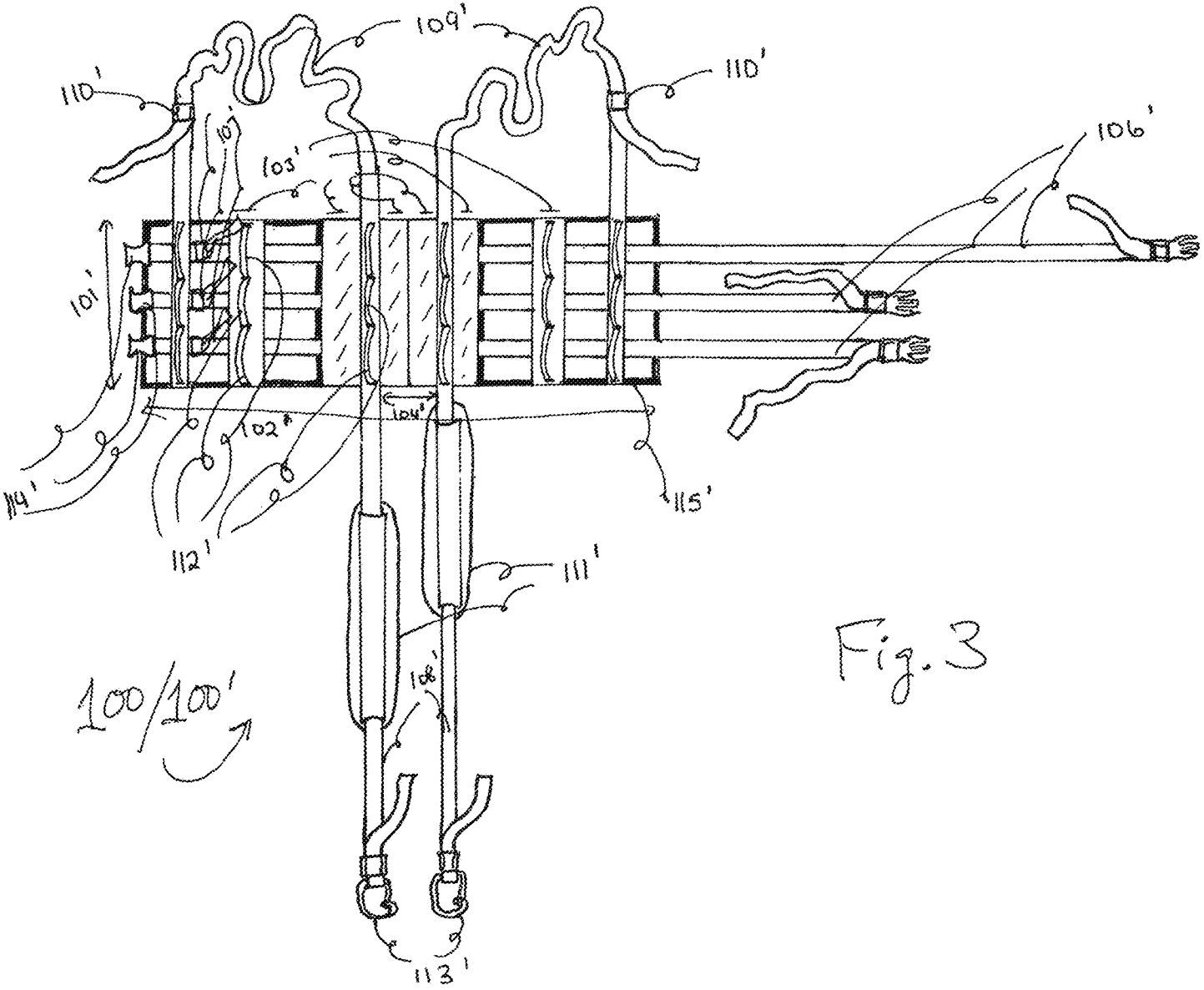
FIG. 3 is an elevational view of the garment of FIG. 1, with its pelvic belt contracted.
Figure 4:
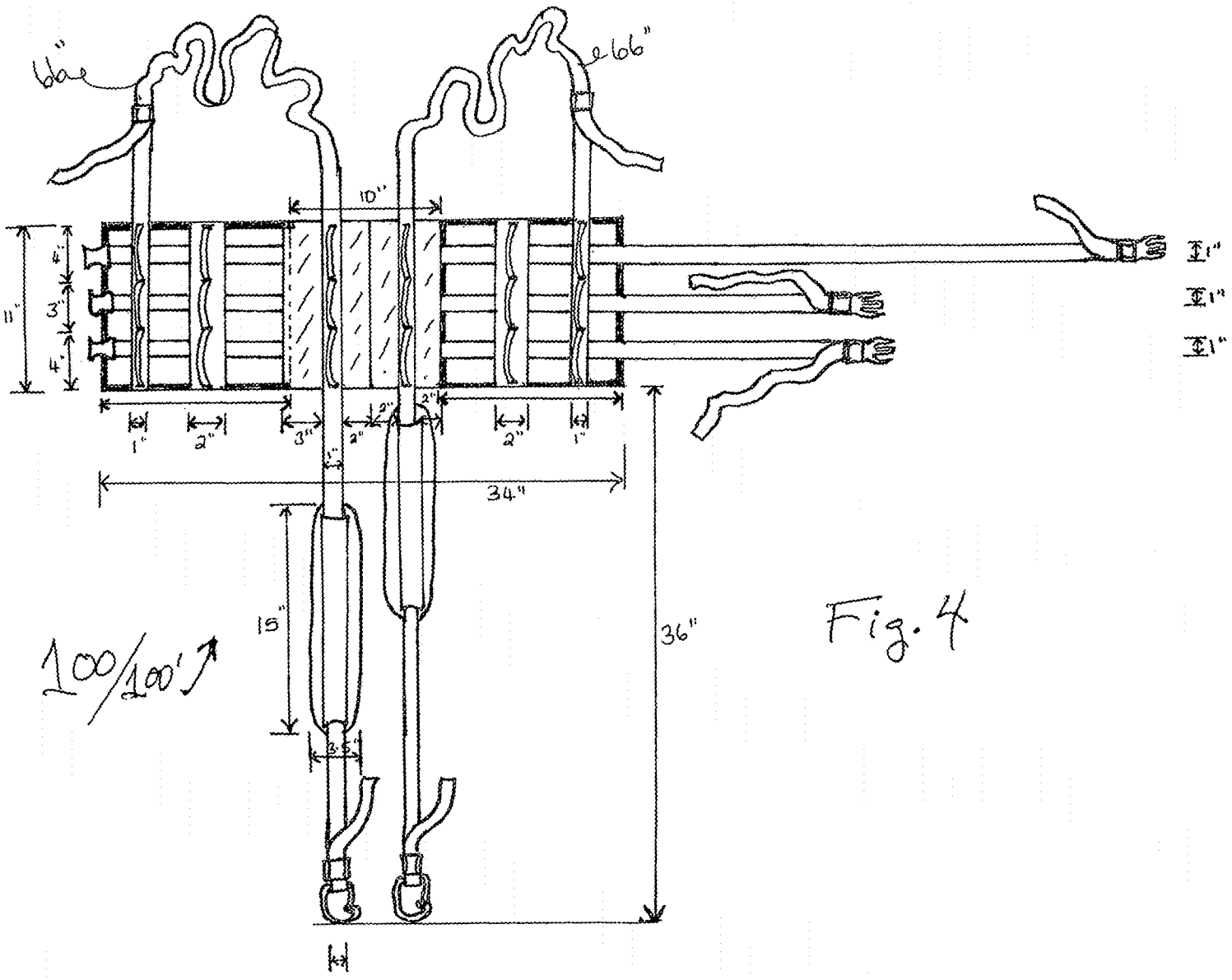
FIG. 4 is an elevational view of the garment of FIG. 1, contracted as in FIG. 3, illustrating some exemplary dimensions in inches.
Figure 6:
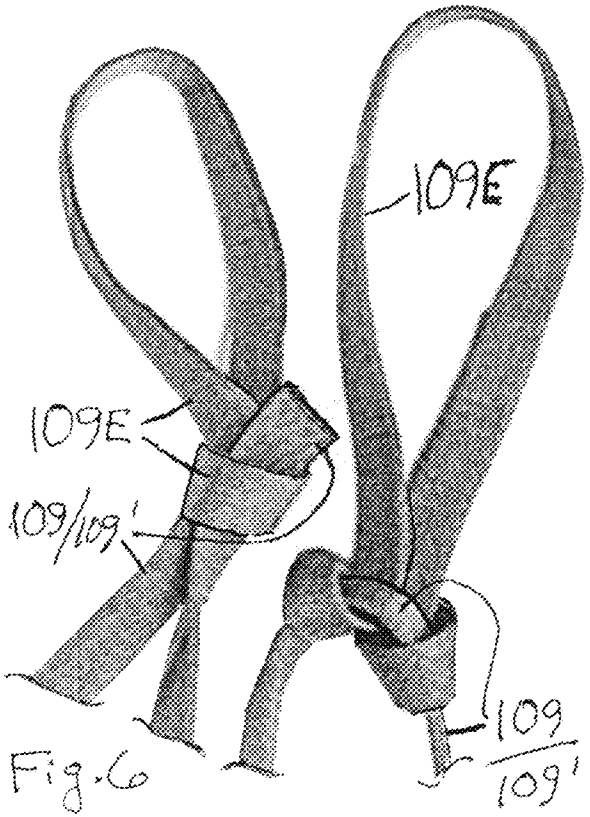
FIG. 6 is an elevational view of extender loops fitted to shoulder straps in the garment of FIG. 1, or such a garment as in FIG. 1 having such shoulder straps, without adjuster mechanisms, fixed to the pelvic belt, say, by sewing each end of a shoulder strap to the pelvic belt body.
Figure 5B:
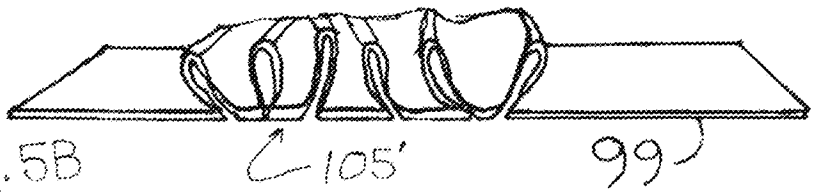
FIG. 5B is a top or bottom view of the pelvic belt portion of the garment of FIG. 1, contracted as in FIG. 3 and folded as in FIG. 5A.
Figure 5A:
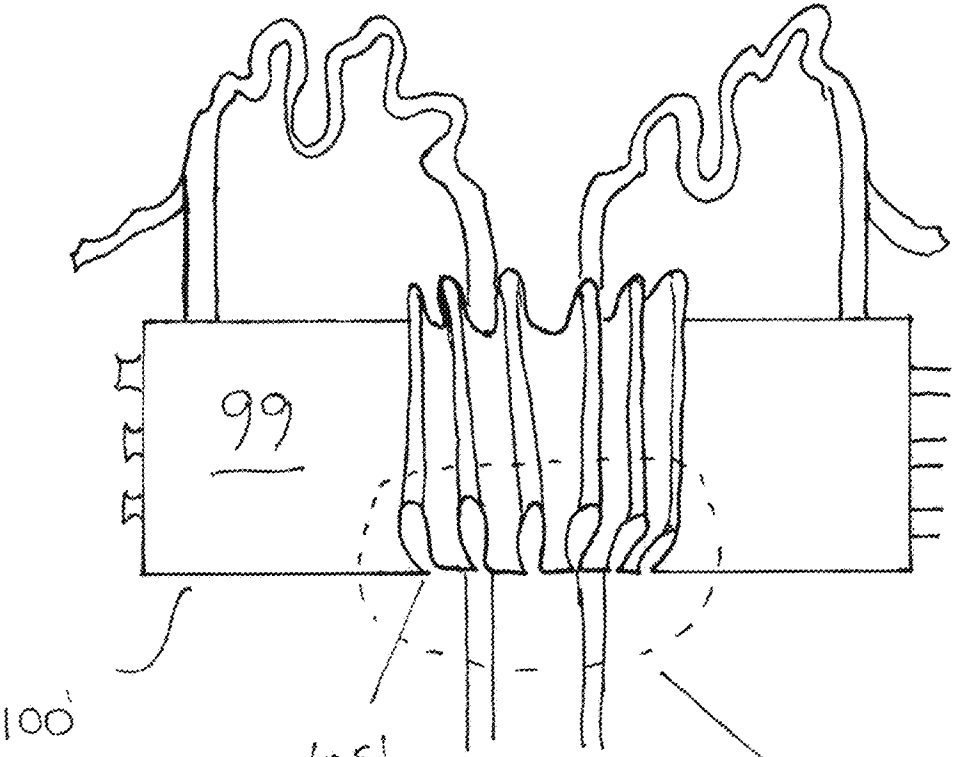
FIG. 5A is an elevational view of the garment of FIG. 1, contracted as in FIG. 3 and folded, in general, showing the side facing internal to, i.e. toward, the patient when it is worn.
Figure 7:
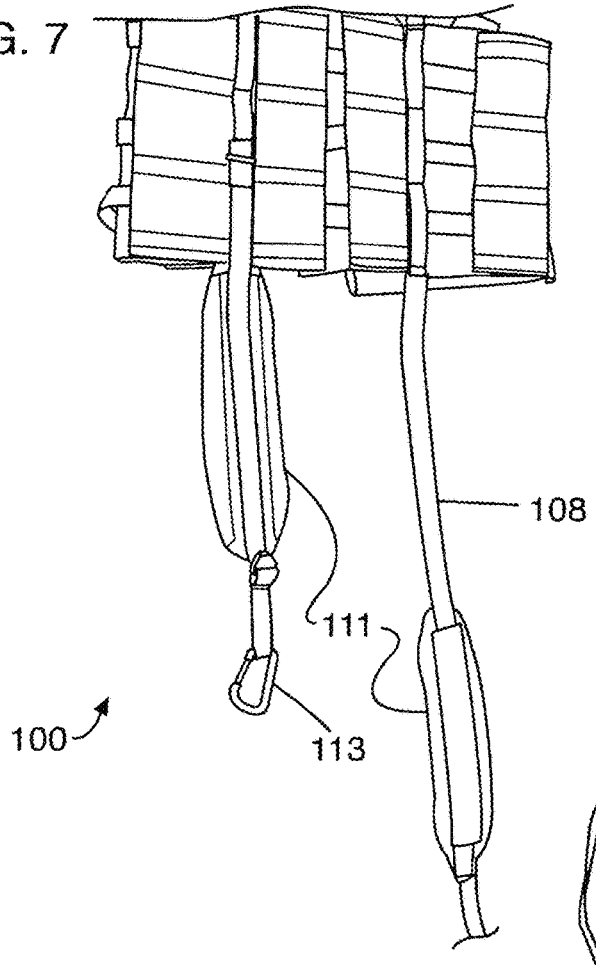
FIG. 7 is an elevational view of a lower part of the pelvic belt portion of the garment in FIG. 1, illustrating generally maximum and minimum length adjustments to its leg straps.
Figure 8:
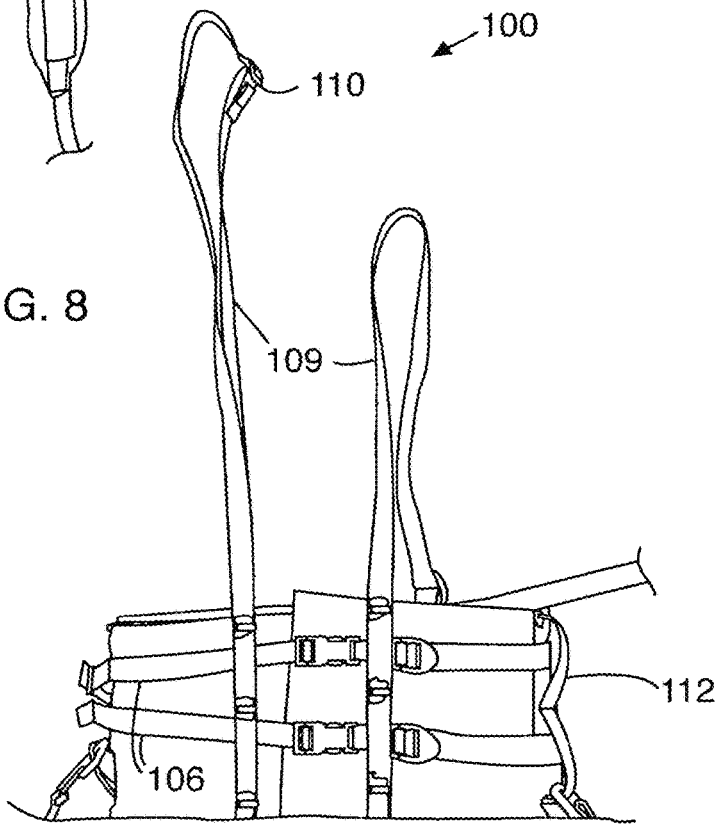
FIG. 8 is an elevational view of an upper part of the pelvic belt portion of the garment in FIG. 1, illustrating generally maximum and minimum length adjustments to its shoulder straps.
Figure 9:
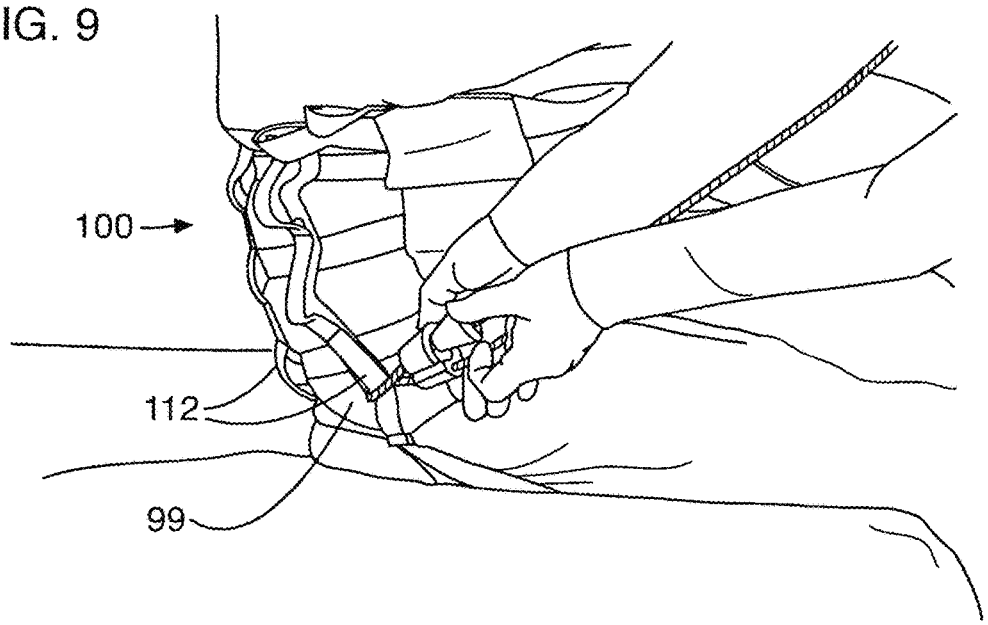
FIG. 9 is an elevational view of the right side of a 395-pound gentleman as patient sitting on a bed and wearing the garment of FIG. 1, with its SARA lock and loop mechanism being fastened and secured as by a nurse.
Figure 10:
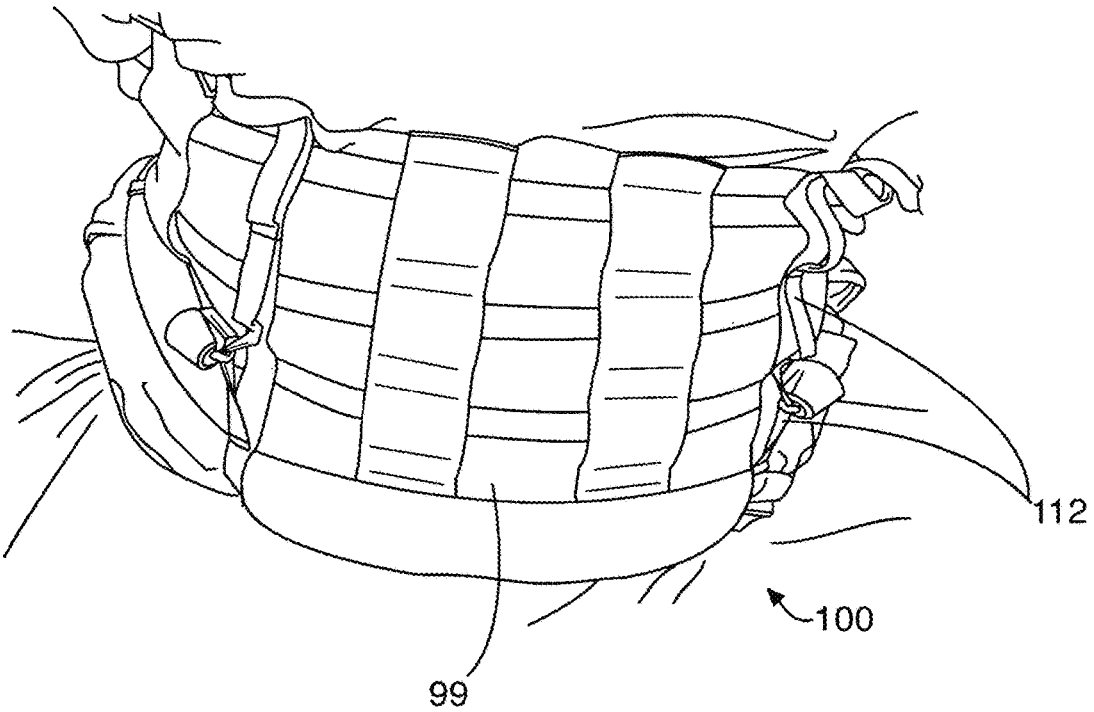
FIG. 10 is a rear view of the patient wearing the garment in FIG. 9 with its SARA lock and loop mechanism set up.
Figure 11:
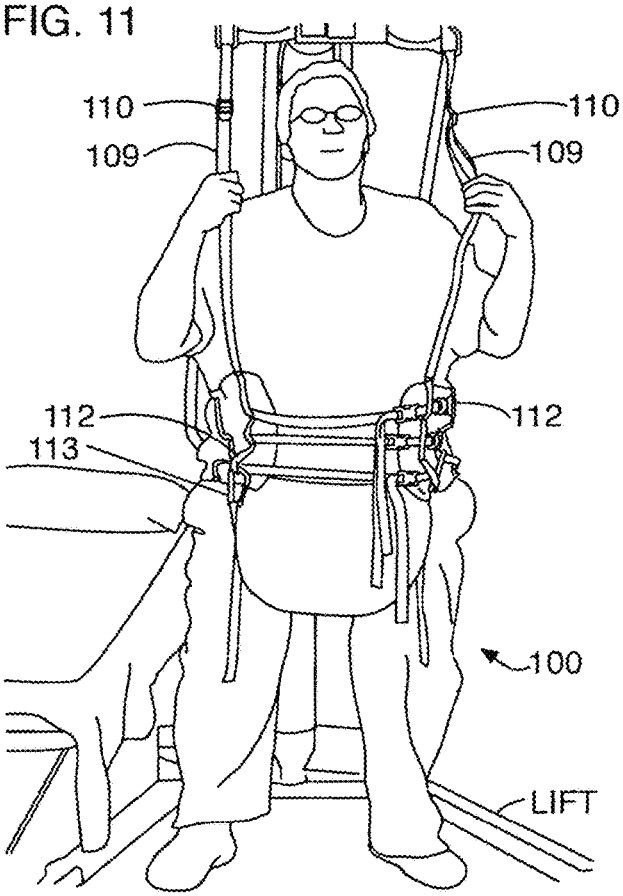
FIG. 11 is a front view of the patient wearing the garment as in FIG. 10, standing.

The invention can be further understood by the detail set forth below. As with the foregoing, the following, which also may be read in view of the drawings, is intended to be taken in an illustrative and not necessarily limiting sense.

The patient mobility garment for nurses includes a flexible, laterally extending pelvic belt body having upper, lower, and opposite side borders. It may have any suitable shape, overall length, width, or thickness. The pelvic belt body may be substantially rectangular and thin.

A plurality of spaced apart structural reinforcement members (ribs) are placed in generally vertical directions that substantially approach or span the upper and lower borders of the pelvic belt. Spacing these apart thus can assist in folding the garment conveniently, to include when it is worn by differently sized patients.

A plurality of loops is vertically positioned with respect to one another about the ribs. These loops may be flexible, but they are strong, for use, for example, through being engaged by suitable fastener(s) terminating the leg straps, or to be used as handles, say, by a nurse.

A plurality of flexible, adjustable length girding straps is provided on the pelvic belt in a horizontal direction. These girding straps can be used to gird the pelvic belt about the pelvis area of the patient and bring the opposite side borders into conjunction or registry. Fixation when in the conjunction or registry may be provided through a girding strap attaching member, for example, a parachute buckle, a punched belt and buckle arrangement, a tie, and so forth.

A plurality of flexible, adjustable length suspension straps (shoulder straps) can be provided on the pelvic belt body. In general, shoulder straps are oriented in what would be the vertical direction when the garment is worn or laid out flat, and may be oriented such that they arise from the pelvic belt directly above the locations where leg straps attach to the pelvic belt, or nearly so. Adjustability may be provided by adjuster mechanisms to adjust length, for example, of a slide-through buckle type. Alternatively, the shoulder straps may not have adjuster mechanisms and be fixed to the pelvic belt body, say, by sewing, to render the primary shoulder straps to be of a set length, which is a very strong provision even suitable for bariatric patients. Extender loops of sufficient strength may be employed to enhance adjustability of already adjustable shoulder straps, or to provide adjustability to set length, fixed shoulder strap members.

A plurality of flexible, depending leg straps is attached to the pelvic belt body, each leg strap terminating with a fastener for engaging at least one of the vertically positioned loops. In general, these are oriented in what would be the vertical direction when the garment is laid out flat, and may be oriented such that they depend from the pelvic belt directly below the locations where the shoulder straps attach to the pelvic belt, or nearly so. The fastener may be a clip, say, a carabiner clip. The leg straps may be provided with leg strap pads wider than the leg straps.

Portions of shoulder and leg straps may be made with the same piece of material.

Any suitable material(s) can be employed to make the present garment. The belt and straps, for instance, may be made with a suitably strong, flexible fabric, leather, plastic, paper, woven fabric, which may contain or have embedded plastic, paper and/or metal strips and/or wires, and so forth. Strong, flexible fabric such as polypropylene or nylon, which may be webbed, may be beneficially employed. A material may have 1,200-pound or greater strength. Components such as buckles, clips, ties, and so forth may be made with suitable metal(s), plastic(s), wood(s), natural and/or artificial fiber(s), and so forth. Cutting, sewing and/or gluing may be employed to make the garment or portion(s) thereof and/or attach component(s).

With respect to the drawings, patient mobility garment for nurses 100/100' (harness/sling) includes the following features:

99: Pelvic belt body.

101/101': Depth, for example, an 11-inch depth, to accommodate the torso size of most children and adults. In general, this represents the minimum amount to support the pelvis of a 95$^{th}$ percentile man, to a child (10-11 years of age).

102/102': Expandable/collapsible girth of the pelvic belt. This is one of the features that make it so unique and multi-size. For example, the fullest width of belt may be a 54-inch width, with the narrowest a 24-inch width, although ribs will ride over each other for a 22-inch fully collapsed girth to fit small children and adults with very narrow waists.

103/103': Vertical webbing ribs. For example, each may have a 2-inch width except for one having a 3-inch width to house a label of the harness. These spaced apart ribs help maintain form in the pelvic belt body 99 from an expanded to a collapsed state, and facilitate proper placement of leg straps at mid-buttock "anatomical landmarks" in patients of different size/girth/body mass distribution.

104/104': Maximum and minimum distances between two leg straps. This is important because even a child, in general, needs a 4-inch width between the vertical straps to be able to position them mid-buttock for maximum support. The maximum distance can be, for example, a16-inch distance, which will accommodate buttock width for 95$^{th}$ percentile male. This is another feature that is unique to this harness, built on the specialized knowledge of body mechanics and knowledge that the support should be from mid buttocks, under the ischial tuberosities (sitting bones) for greatest comfort and support, and for least amount of riding up of the harness 100/100' if the patient does fall.

105/105': Collapsible folds of flexible material that allow for expansion and collapse of the harness 100/100'. Collapse is by forming folds that lay along an inner surface of the pelvic belt body 99. The material is lightweight but strong, and does not bulk up when folded during collapsing for narrower girths with smaller patients.

106/106': Adjustable length circumferential girding straps. These can have a 68-inch length at their longest, allowing the harness 100/100' to fit at the maximum girth, which would be a 65-inch girth, with a 3-inch tail on the strap. The configuration depicted has three straps 106/106' with instructions that at least two must be tight and snug around the patient's girth. This accommodates variable body shapes and special needs, for example, through specialized knowledge of patient condition so that use of the harness 100/100' can be carried out with patients having chest tubes, drains, pumps either sub-cutaneously or stoma bags after surgery, and so forth. The configuration depicted allows for one strap to be left undone to accommodate different body shapes and/or provide a gap for such devices. The girding straps are fed through gaps between the pelvic belt 99 and ribs 103/103'.

107/107': Length adjuster mechanism for the girding straps. Each girding strap 106/106' has a dual length adjuster mechanism. This provides ease of use for the clinician. This is another feature that specialized knowledge in end user factors informed for the configuration. Users are busy and will not fuss with features that are difficult to use. Providing the features in such a way that donning and doffing are easy, and that achieving a good fit is easy, increases utilization, adoption of safe practices, and safety for the patients. Poorly fitting harnesses or slings would be hazardous to patients, and the configuration of this length adjuster mechanism 107/107' allows for easy fit in patients of variable shapes and sizes.

108/108': Adjustable length leg straps. Each leg strap can be a continuous strap from a corresponding shoulder strap, through the body of the belt, and to the leg straps. The leg straps are imperative for fall prevention. Having them continuous with shoulder straps maximizes strength and minimizes riding up of the belt on the patient. Riding up of a sling is a dis-satisfier for patients and clinicians. Having "pulling force," i.e., attachment to the overhead lift, and "stabilizing force," i.e., force from the leg supports through the legs, gives the best support, best comfort, and the least riding up possible.

109/109': Adjustable length shoulder straps. These accommodate tall, medium and short patients, through their adjustable features. Clinicians will be most likely to adopt safe practices when they easily can get a good fit on many different patients with one harness. When they have too many options from which to choose, clinicians end up resorting to old ways of doing things (manual, unsafe ways).

109E: Extender loops. These can be of various sizes and employed to provide additional length, and hence, additional adjustability, to the adjustable length shoulder straps 109/109', or to provide adjustability to set length, fixed shoulder straps by extending their length a predetermined amount.

110/110': Adjustable buckle mechanisms on the adjustable shoulder straps 109/109'. Different patients have different torso lengths, and various facilities have different lifts, with variable height hanger bars to which the shoulder straps can connect. Having adjustable length shoulder straps allows for maximum versatility in accommodating different patient heights, and facility and lift heights.

111/111': Sliding leg pads. These are configured to give the right amount of support under the "sit bones," and they slide along the adjustable length leg strap to enable the caregiver to place the pad in the right place. This varies with different patient sizes; so the adjustability is key to achieving proper fit and support. The leg pads slide on the leg straps 108/108' to accommodate various thigh and/or buttock body dimensions, and provide "lift support," under buttock ("sit") bone in patients of various shapes and sizes.

112/112': Vertical webbing loops. These are attached to the webbing ribs 103/103' to provide anchor placement as for a clip, for example, a carabiner clip, on the leg strap 108/108'. There are multiple loops around the belt 99, which enable the caregiver to further adjust the fit and tightness/looseness of the leg strap 108/108' to fit each patient. These loops 112/112' are also long enough, for example, with 3-inch and 4-inch lengths, so that clinicians can place fingers through them to aid in cuing the patient during walking. Cuing entails providing feedback to the patient through touch and gentle pressure, which helps the patient know where he needs to be. For example, if a patient is walking, and leans to one side, the nurse may gently pull a loop 112/112' to "cue" the patient to come back to the middle position where it is safest for him to walk. The multiplicity of loops 112/112' also provides ease of this function for caregivers of various arm lengths, who can readily find a loop 112/112' with which to hold or guide the patient.

113/113': Leg strap fasteners, for example, carabiners. These easily opened/closed clips can have a 1200-pound tensile strength rating along vertical and horizontal axes, making them ideal to attach the adjustable length leg straps 108/108' to whichever of the vertical loops 112/112' along the pelvic belt 99 that achieve(s) the desired snug fit. They are easy to open and close, and easy to adjust if the first point of connection is found to be less than desired. Regarding the length of the leg strap 108/108', when the harness 100/100' is applied during sitting, the leg strap 108/108' will be shorter than when the patient stands up owing to the hip joint being bent (flexed) in sitting and straightened (extended) in standing. The present configuration promotes an ability to have the harness 100/100' snug in sitting, but then adjusted as the patient stands up, to still provide the right amount of support without restricting movement in the hip.

114/114': Parachute buckles as the girding strap attaching contrivance for connecting the circumferential girding straps 106/106'.

Figure 12:
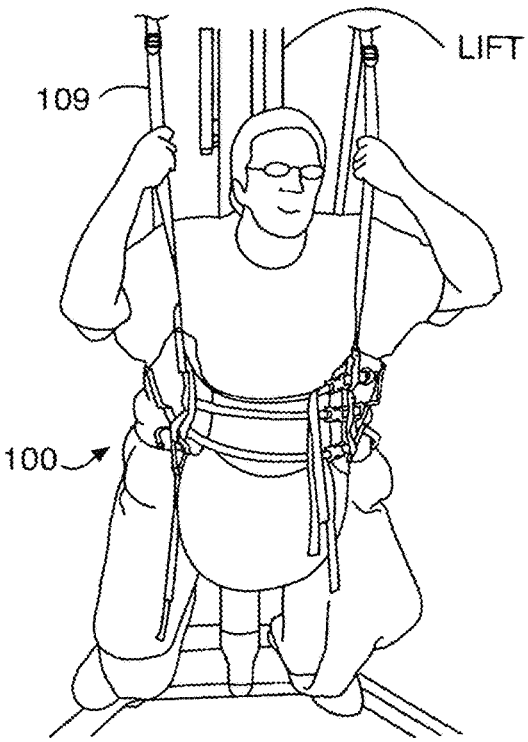
FIG. 12 is a front view of the patient wearing the garment as in FIG. 11, as if falling.
Figure 13:
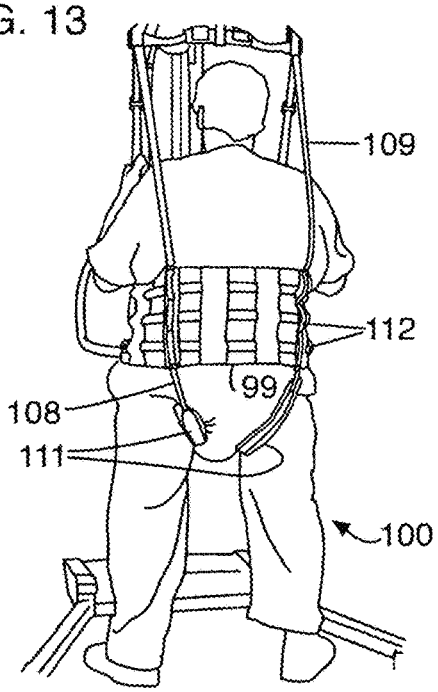
FIG. 13 is a rear view of the patient wearing the garment as in FIG. 10, standing.
Figure 14:
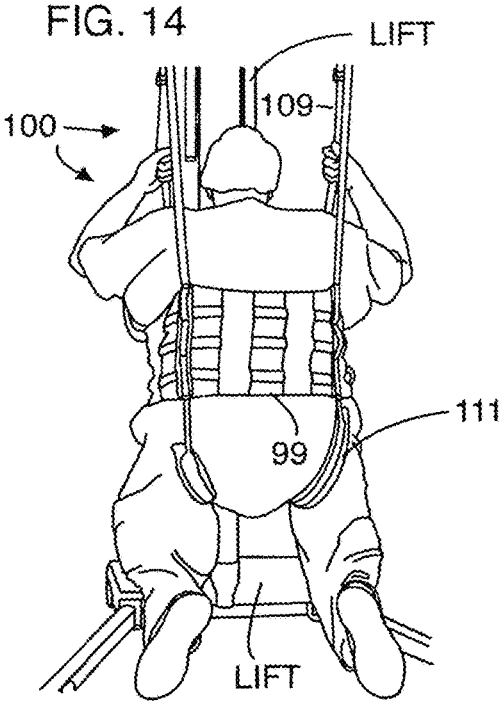
FIG. 14 is a rear view of the patient wearing the garment as in FIG. 11, as if falling.
Figure 15:
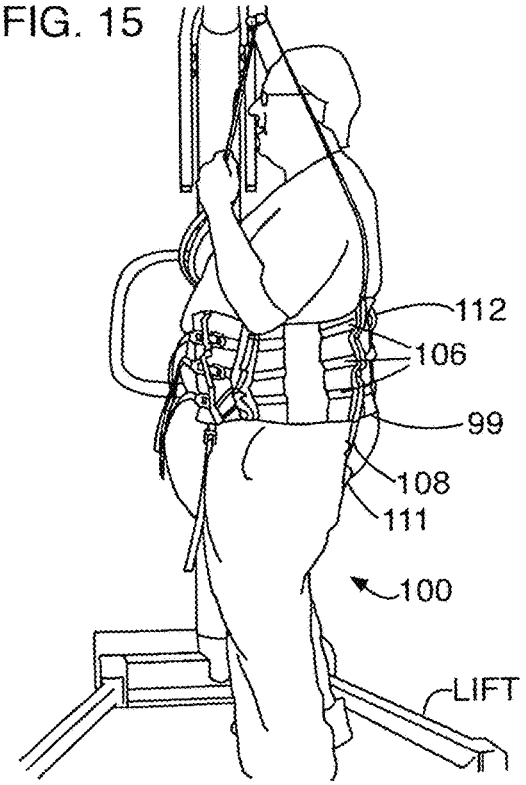
FIG. 15 is a side view of the patient wearing the garment as in FIG. 10, standing.
Figure 16:
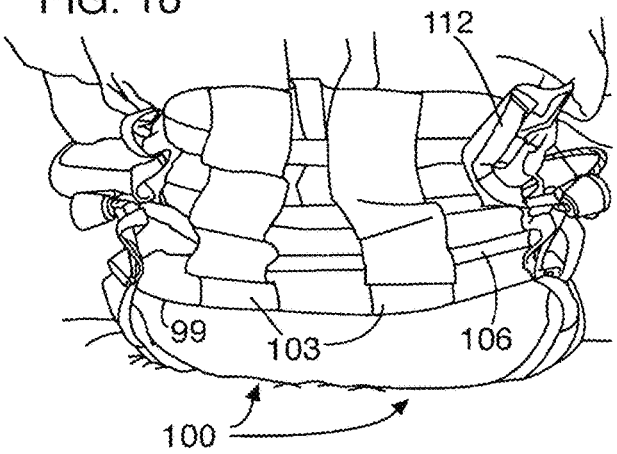
FIG. 16 is a rear view of a 210-pound gentleman as patient sitting on a bed and wearing the garment of FIG. 1, with its SARA lock and loop mechanism set up.
Figure 17:
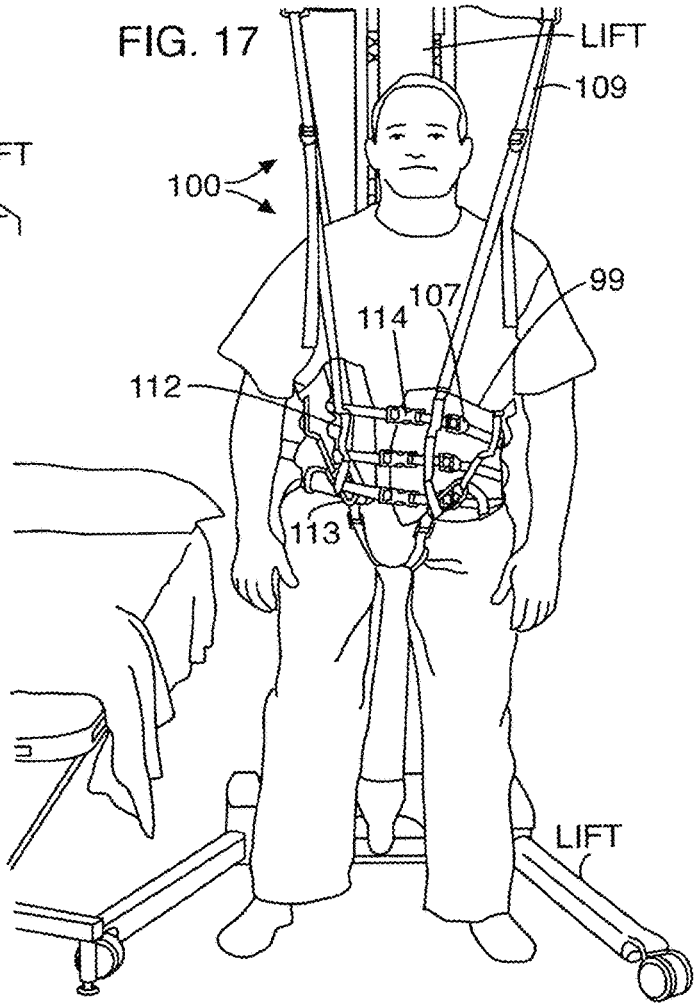
FIG. 17 is a front view of the patient wearing the garment as in FIG. 16, standing.
Figure 18:
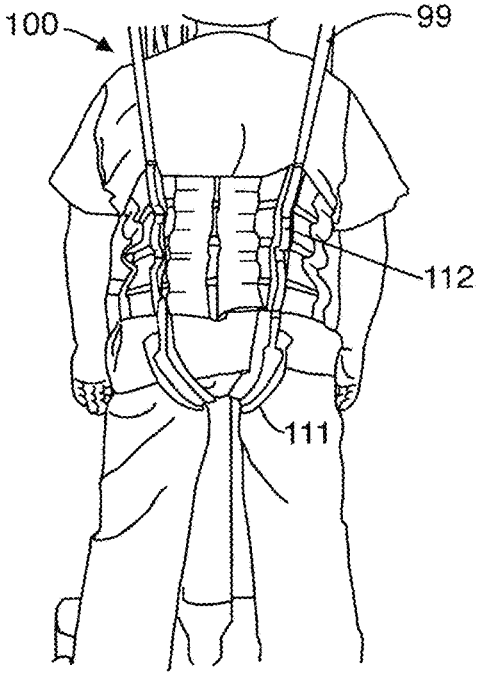
FIG. 18 is a rear view of the patient wearing the garment as in FIG. 16, standing.
Figure 19:
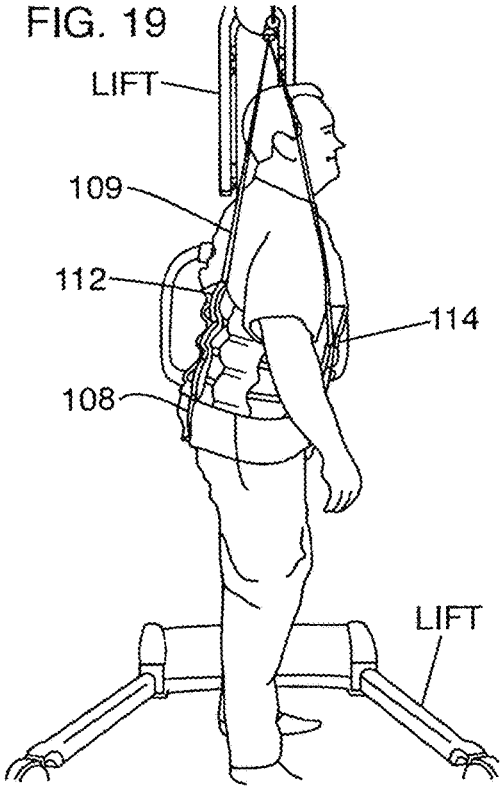
FIG. 19 is a side view of the patient wearing the garment as in FIG. 16, standing.
Figure 20:
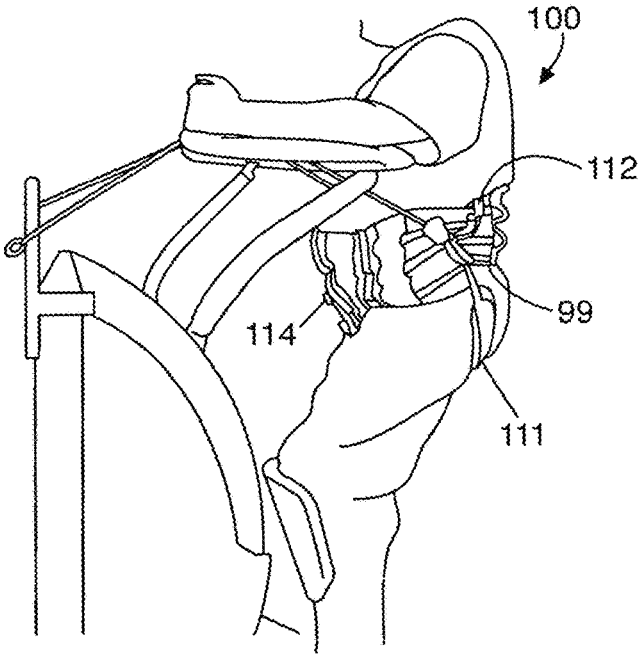
FIG. 20 is a side view of the patient wearing the garment as in FIG. 16, standing with the help of the SARA having the lock and loop mechanism.
Figure 21:
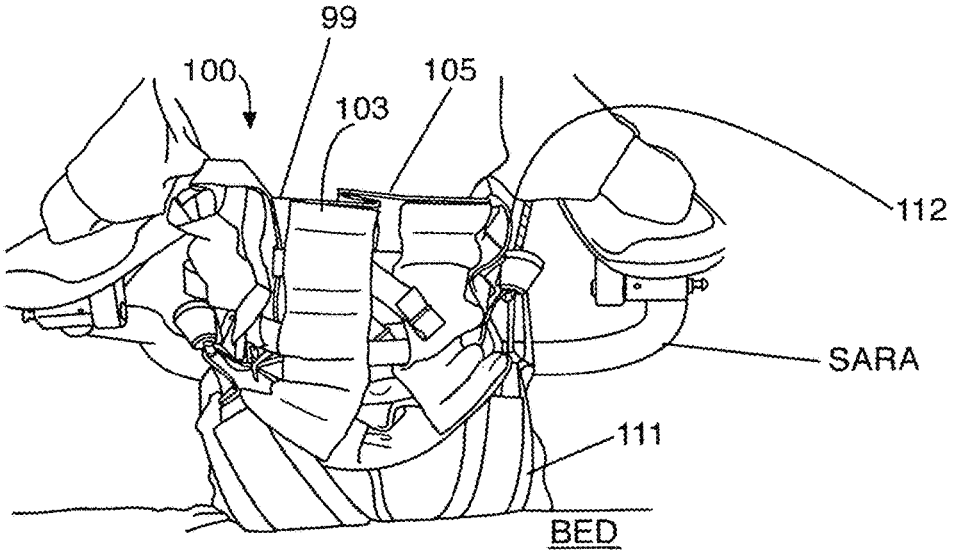
FIG. 21 is a rear view of a 75-pound boy as patient sitting on a bed and wearing the garment of FIG. 1, with its SARA lock and loop mechanism set up.
Figure 22:
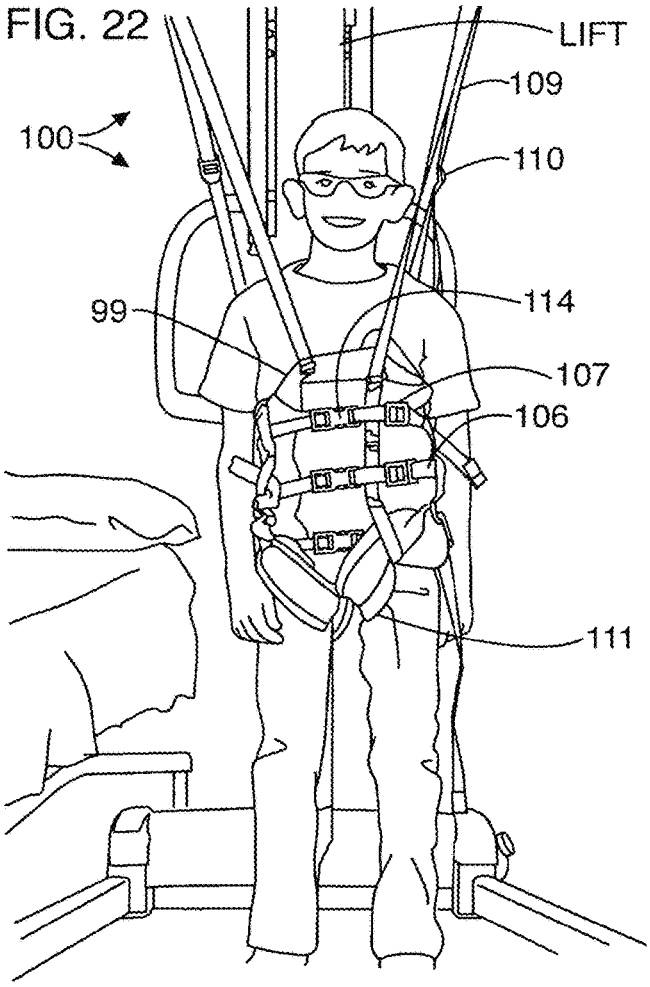
FIG. 22 is a front view of the patient wearing the garment as in FIG. 21, standing.
Figure 23:
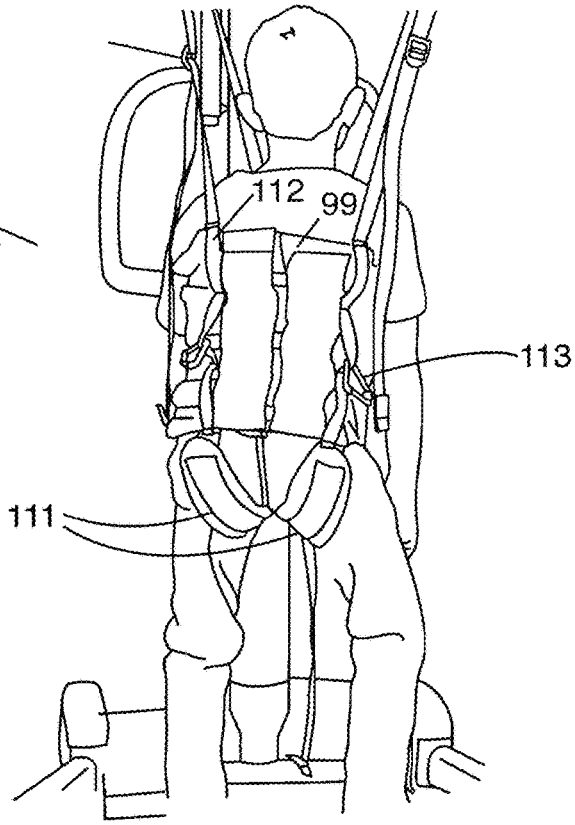
FIG. 23 is a rear view of the patient wearing the garment as in FIG. 21, standing.
Figure 24:
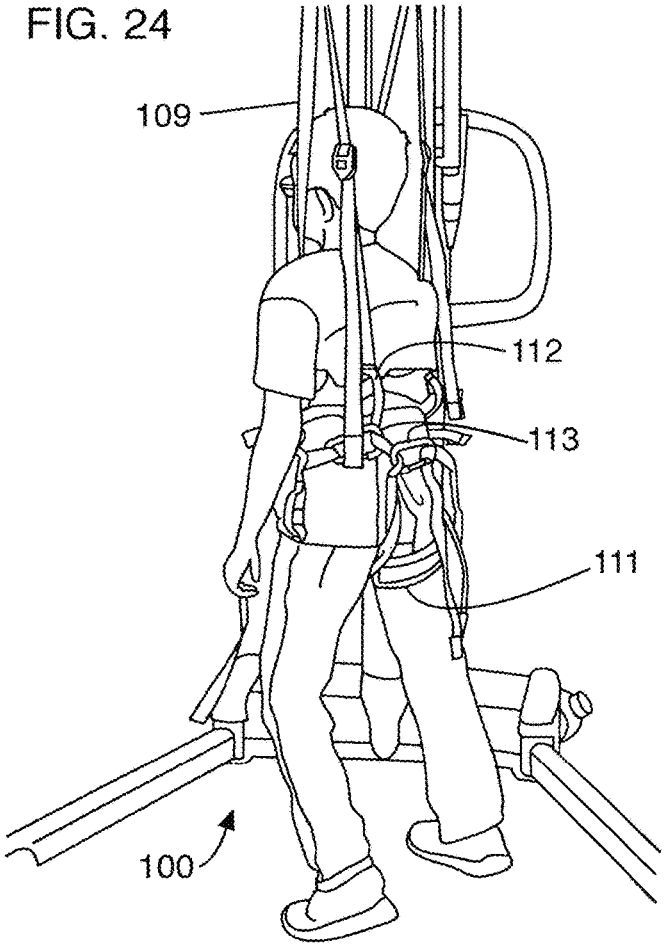
FIG. 24 is a side view of the patient wearing the garment as in FIG. 21, standing.
Figure 25:
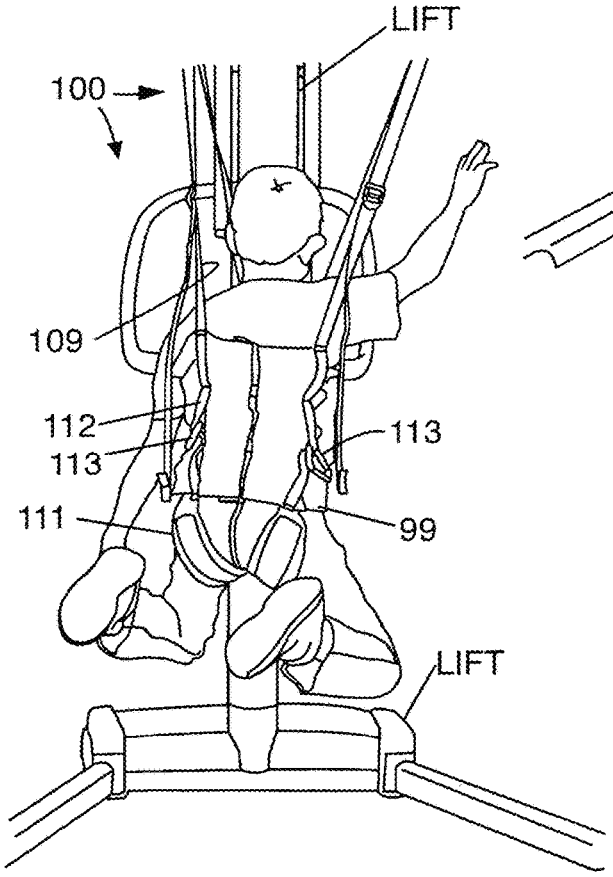
FIG. 25 is a rear view of the patient wearing the garment as in FIG. 21, swinging.

Of note from viewing the drawings, to include FIGS. 12, 14, 20 and 25, is that support by the present garment 100/100' with its pelvic belt body 99, in particular, remains in place around the waist/pelvis when the patient "falls" or exercises. Also as seen in the rear views of FIGS. 13, 14, 16, 18, 23 and 25, with all three sizes of the exemplary patients depicted, from the 395-pound adult to the 75-pound child, the leg support straps 108/108' and suspension (shoulder) straps 109/109' are approximately at the midline of the buttocks, providing support where most needed.

Dimensions herein, to include in the drawings, may be considered exact or approximate. For example, an approximate dimension may vary from a stated dimension or range, say, about 1%, about 2-1/2%, about 5%, about 7-1/2%, about 10%, about 15%, about 20%, about 25%, about 33% and so forth, and any selected upper and lower limit thereof, say, about from 1% to 15%, 2% to 7-1/2%, about from 5% to 10%, 25% or 33%, about from 10% to 20% and so forth, from a stated dimension or range. As an illustration, variances from a stated dimension can be about 5% or about 10% from a stated dimension, or about from 5% to 10% from a stated range.

EPILOGUE

Although the present garment is particularly beneficial for nurses, who appreciate its simplicity and utility, this does not rule out its use by therapists when using assistive devices to augment their patient's performance. Rather, it is a very good solution for therapists, to include for the most common tasks. Complex tasks may yet require the garment of Arnold's '832 patent.

INCORPORATIONS BY REFERENCE

The aforementioned provisional application No. 62/764,579 and U.S. Pat. No. 9,420,832 B2 are incorporated herein by reference in their entireties, to include their drawings.

CONCLUSION TO THE INVENTION

The present invention is thus provided. Various feature(s), part(s), step(s), subcombination(s) and/or combination(s) can be employed with or without reference to other feature(s), part(s), step(s), subcombination(s) and/or combination(s) in the practice of the invention, and numerous and sundry adaptations can be effected within its spirit, the literal claim scope of which is particularly pointed out by the following claims:

What is claimed is:

1. A patient mobility garment for a nurse to employ on a patient who has a pelvis and a pelvic area, which comprises a flexible, laterally extending pelvic belt body having upper, lower, and opposite side borders, and in conjunction therewith, the following:

a plurality of spaced apart structural reinforcement members (ribs) placed in generally vertical directions that substantially approach or span the upper and lower borders;

a plurality of loops vertically positioned with respect to one another about the ribs;

a plurality of flexible, adjustable length girding straps horizontally oriented with respect to the pelvic belt body and configured to gird the pelvic belt body about the pelvis area of the patient and bring the opposite side borders into conjunction or registry, each girding strap having a girding strap attaching member for fixation of the girding straps;

a plurality of flexible, adjustable length suspension straps (shoulder straps); and a plurality of flexible, depending leg straps, each terminating in a fastener for engaging at least one of the vertically positioned loops.

2. The garment of claim 1, wherein the pelvic belt body is substantially rectangular and thin.

3. The garment of claim 1, wherein the ribs are spaced apart such that they assist in folding the garment.

4. The garment of claim 1, wherein the loops in the plurality of loops are flexible.

5. The garment of claim 1, wherein fixation of the girding straps is by at least one of a parachute buckle, a punched belt and buckle arrangement, and a tie.

6. The garment of claim 1, wherein the shoulder straps of the plurality of shoulder straps are oriented in what would be the vertical direction when the garment is laid out flat, and are oriented such that they arise from the pelvic belt body directly above the locations where the leg straps attach to the pelvic belt body, or nearly so.

7. The garment of claim 6, wherein adjustability of the shoulder straps is provided by length-adjuster mechanisms of a slide-through buckle type.

8. The garment of claim 1, wherein the leg straps are oriented in what would be the vertical direction when the garment is laid out flat, and are oriented such that they depend from the pelvic belt body directly below the locations where the shoulder straps attach to the pelvic belt body, or nearly so; and the fastener is a clip.

9. The garment of claim 8, wherein the clip is a carabiner clip.

10. The garment of claim 2, wherein the ribs are spaced apart such that they assist in folding the garment; the loops in the plurality of loops are flexible; fixation of the girding straps is by at least one of a parachute buckle, a punched belt and buckle arrangement, and a tie; the shoulder straps of the plurality of shoulder straps are oriented in what would be the vertical direction when the garment is laid out flat, and are oriented such that they arise from the pelvic belt body directly above the locations where the leg straps attach to the pelvic belt body, or nearly so; and adjustability of the shoulder straps is provided by length-adjuster mechanisms of a slide-through buckle type; and the leg straps are oriented in what would be the vertical direction when the garment is laid out flat, and are oriented such that they depend from the pelvic belt body directly below the locations where the shoulder straps attach to the pelvic belt body, or nearly so; and the fastener is a clip.

11. The garment of claim 1, which is a one-piece garment.

12. The garment of claim 2, which is a one-piece garment.

13. The garment of claim 3, which is a one-piece garment.

14. The garment of claim 4, which is a one-piece garment.

15. The garment of claim 5, which is a one-piece garment.

16. The garment of claim 6, which is a one-piece garment.

17. The garment of claim 7, which is a one-piece garment.

18. The garment of claim 8, which is a one-piece garment.

19. The garment of claim 9, which is a one-piece garment.

20. The garment of claim 10, which is a one-piece garment.

21. A patient mobility garment for a nurse to employ on a patient who has a pelvis and a pelvic area, which comprises a flexible, laterally extending pelvic belt body having upper, lower, and opposite side borders, and in conjunction therewith, the following:

a plurality of spaced apart structural reinforcement members (ribs) placed in generally vertical directions that substantially approach or span the upper and lower borders;

a plurality of loops vertically positioned with respect to one another about the ribs;

a plurality of flexible, adjustable length girding straps horizontally oriented with respect to the pelvic belt body and configured to gird the pelvic belt body about the pelvis area of the patient and bring the opposite side borders into conjunction or registry, each girding strap having a girding strap attaching member for fixation of the girding straps;

a plurality of flexible, suspension straps (shoulder straps) having a set length, which are fixed on each end to the pelvic belt body; and a plurality of flexible, depending leg straps, each terminating in a fastener for engaging at least one of the vertically positioned loops.

22. The garment of claim 21, wherein extender loops are looped onto the shoulder straps.

* * * * *